US010518316B1

(12) United States Patent
Brown et al.

(10) Patent No.: US 10,518,316 B1
(45) Date of Patent: Dec. 31, 2019

(54) PROCESS FOR MANUFACTURING A NEAR PERFECT ROUND BALL BEARING WITH A HOLE THERE THROUGH

(71) Applicants: Vern T. Brown, Menifee, CA (US); Collin M. Seib, Vancouver (CA); Michael Kenneth Walker, Whittier, CA (US)

(72) Inventors: Vern T. Brown, Menifee, CA (US); Collin M. Seib, Vancouver (CA); Michael Kenneth Walker, Whittier, CA (US)

( * ) Notice: Subject to any disclaimer, the term of this patent is extended or adjusted under 35 U.S.C. 154(b) by 26 days.

(21) Appl. No.: 15/989,116

(22) Filed: May 24, 2018

(51) Int. Cl.

| | |
|---|---|
| ***B21K 1/00*** | (2006.01) |
| ***B21K 1/02*** | (2006.01) |
| ***B21H 1/12*** | (2006.01) |
| ***F16C 33/00*** | (2006.01) |

(52) U.S. Cl.
CPC ..... *B21K 1/02* (2013.01)

(58) Field of Classification Search
CPC .. F16C 33/00; B21K 1/02; B21K 1/12; B21K 1/16; B21K 1/00; Y10T 29/49996; Y10T 29/49664
See application file for complete search history.

(56) References Cited

U.S. PATENT DOCUMENTS 1,857,997 A * 5/1932 Brennan ..... B21K 1/02 72/337
2,365,562 A * 12/1944 Koehring ..... B22F 3/11 419/66
2,941,290 A * 6/1960 Heim ..... B21K 1/02 72/339

* cited by examiner

*Primary Examiner* — Ryan J. Walters
*Assistant Examiner* — Lawrence Averick
(74) *Attorney, Agent, or Firm* — Edward P. Dutkiewicz

(57) ABSTRACT

A process of compressing a slug to have tapered ends, then reforming the slug to change the configuration to a shorter length with a larger diameter across the center of the slug. The slug is then reformed and a hole pressed there through, with the pressing of the partial hole reforming the configuration to have a near perfect radius with a hole through the slug, whereby a near prefect ball is made, and the ball has a hole there through.

2 Claims, 9 Drawing Sheets

Fig. 7A
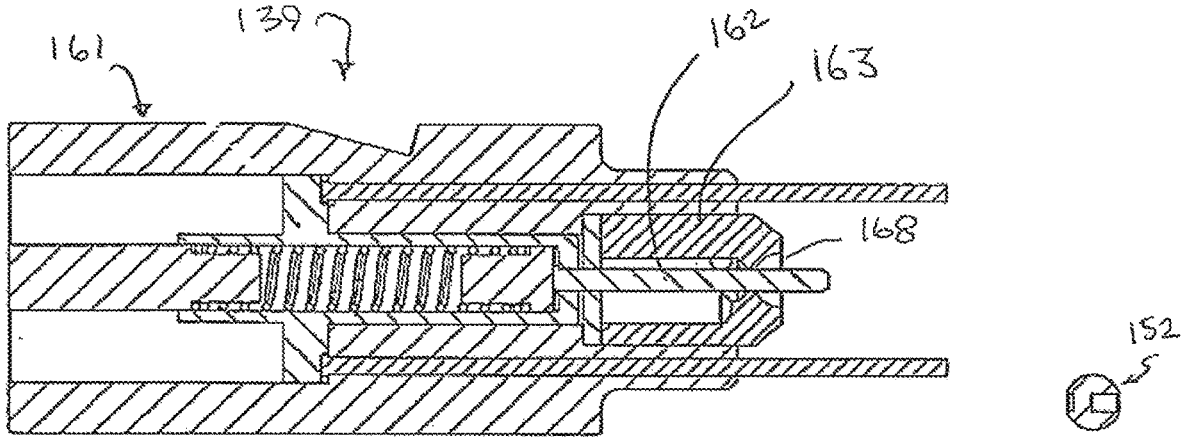
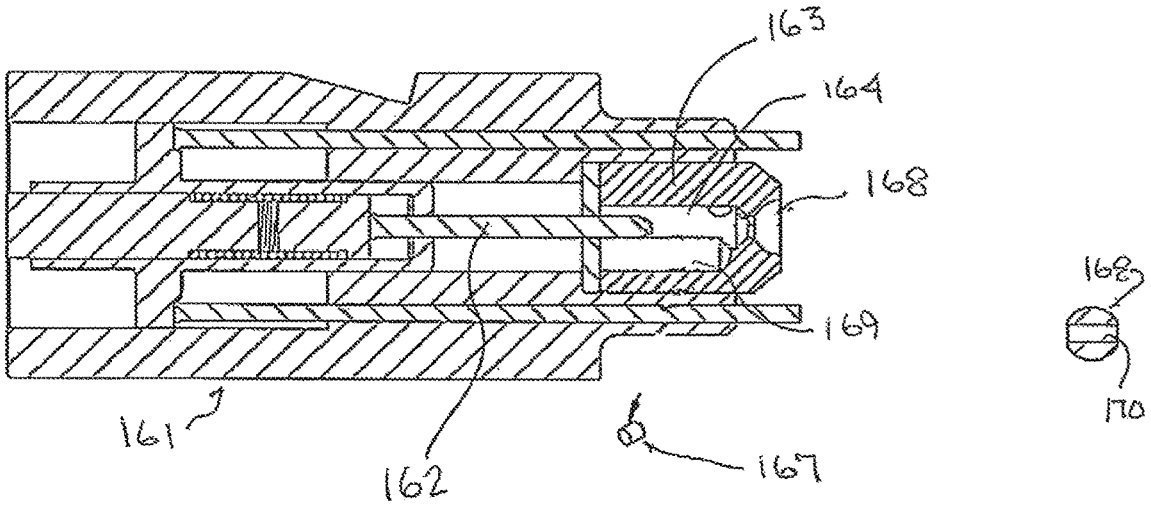
Fig. 7B

Fig. 8A
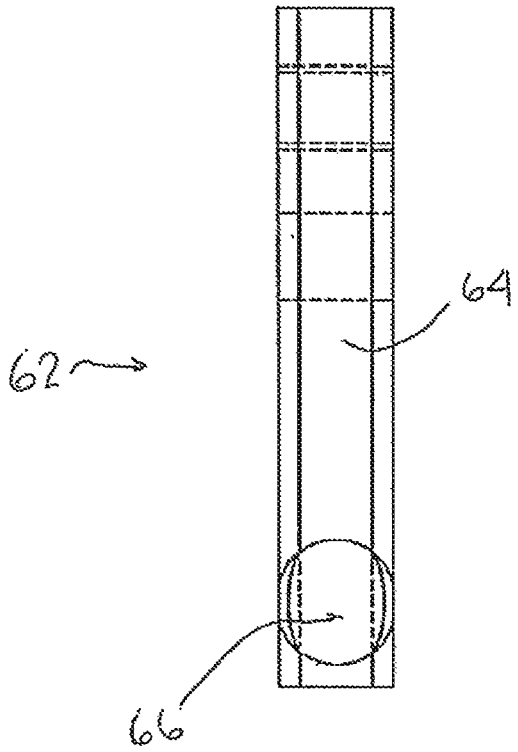
Fig. 8B
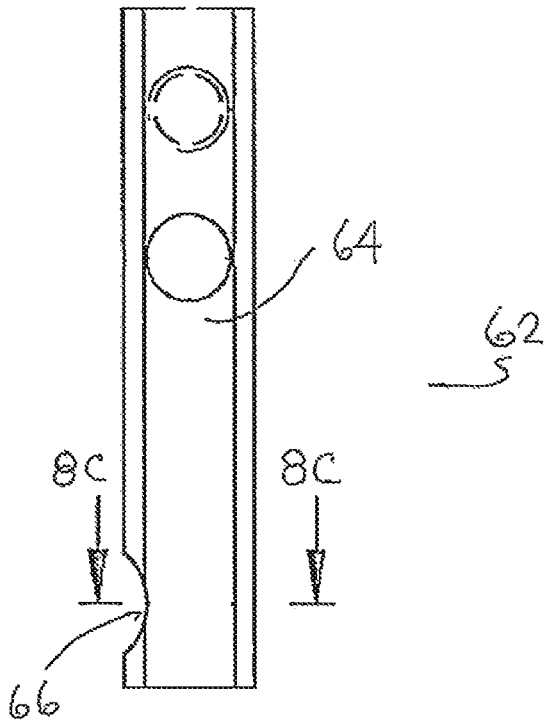
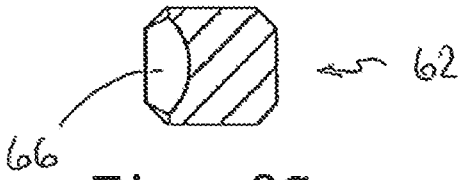
Fig. 8C

Fig. 10A
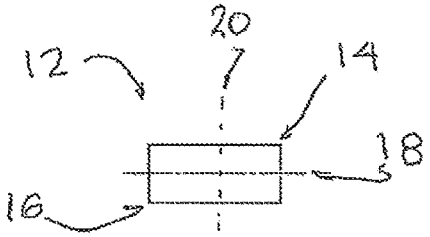
Fig. 10B
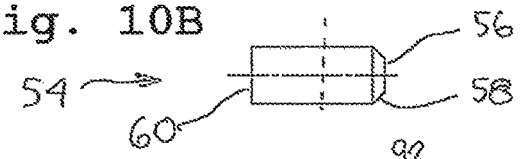
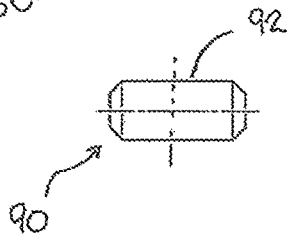
Fig. 10C
Fig. 10D
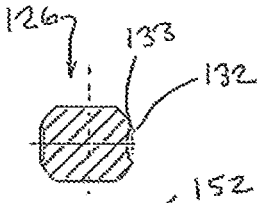
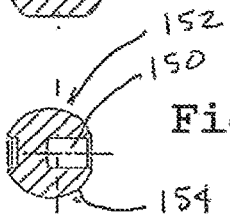
Fig. 10E
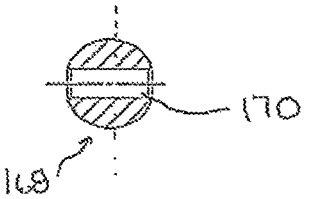
Fig. 10F

PROCESS FOR MANUFACTURING A NEAR PERFECT ROUND BALL BEARING WITH A HOLE THERE THROUGH

BACKGROUND OF THE INVENTION

Rule 1.78(F)(1) Disclosure

The Applicants have not submitted a related pending or patented non-provisional application within two months of the filing date of this present application. All of the inventors have been herein disclosed. This application is not under assignment to any other person or entity at this time.

FIELD OF THE INVENTION

The present invention relates to a process for manufacturing a near perfect round ball bearing with a hole there through.

DESCRIPTION OF THE PRIOR ART

The use of methods to make ball bearings is known in the prior art. More specifically, methods to make ball bearings previously devised and utilized for the purpose of manufacturing near perfect ball bearings are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe a process for manufacturing a near perfect round ball bearing with a hole there through.

In this respect, the process for manufacturing a near perfect round ball bearing with a hole there through, according to the present invention, substantially departs from the conventional concepts and designs of the prior art, and in doing so provides an apparatus primarily developed for the purpose of making near perfect ball bearings with a hole there through.

Therefore, it can be appreciated that there exists a continuing need for a new and improved process for manufacturing a near perfect round ball bearing with a hole there through. In this regard, the present invention substantially fulfills this need.

SUMMARY OF THE INVENTION

In view of the foregoing disadvantages inherent in the known types of methods to make ball bearings now present in the prior art, the present invention provides an improved process for manufacturing a near perfect round ball bearing with a hole there through. As such, the general purpose of the present invention, which will be described subsequently in greater detail, is to provide a new and improved process, or method, for manufacturing a near perfect round ball bearing with a hole there through, in which the method claimed has all the advantages of the prior art and none of the disadvantages.

In describing this invention, the word "coupled" may be used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially, mechanically, continuous with one another.

By adjacent to a structure is meant that the location is near the identified structure.

To attain the objectives of the invention, the present invention essentially comprises a process for manufacturing a near perfect round ball bearing having a hole there through. The method, or process, comprises several steps, in combination.

The first step is providing a slug of a material. The slug has a round solid tubular configuration. The slug has a first end and a second end, with a first overall length there between. The length of the slug has a centerline which defines the central axis of the slug. The slug first length has a mid length which locates the middle of the length of the slug, or the middle of the slug. The first length of the slug has a first length circumference and first length radius. The first end of the slug and the second end of the slug each have the first length radius.

The second step is providing placing the slug into a first cold forging device. The first cold forging device has a first cold forging station and a second cold forging station. The first cold forging device has a hammer assembly and a die assembly. The hammer assembly has a hammer assembly case, hammer pin, a hammer insert, and hammer spacer. The hammer insert has a hole there through, through which the hammer pin passes. The hammer pin has a flat end surface. The die assembly has a die case, a dies spacer, and a die insert and a die pin. The die insert has a hole there through, through which the die pin passes. The die insert has a centrally located recess therein with the centrally located insert recess having a radial configuration, having a first radius, around the insert hole. The die pin of the first cold forging device, first cold forging station has a flat end having a second diameter.

The first cold forging device first cold forging station die forms the first end of the slug to a flat first end having the second diameter with an adjacent first end radius. The first end radius runs from the first flat end to the first length circumference. The second end of the slug is contacted by the hammer pin of the hammer assembly, and is maintained in a flat, first diameter, configuration.

The next step is providing a turn around device. The turn around device removes the slug from the first cold forging device first cold forging station and then turns the slug one hundred and eighty degrees and then inserting the slug into the first cold forging device second cold forging station.

The next step provides the first cold forging device second cold forging station reforming the second end of the slug. The second cold forging station, like the first cold forging station, has a hammer assembly and a die assembly. The first cold forging device second cold forging station hammer assembly has a hammer pin with a configuration which mates with the slug first flat end, having the second diameter, and the adjacent first end radius. The die assembly has a die case and a die insert and a die pin. The die insert has a hole there through, through which the die pin passes. The die pin of the first cold forging device second cold forging station has a flat end. The first cold forging device second cold forging station die insert has a centrally located recess therein with the centrally located insert recess having a radial configuration, having a first radius, around the insert hole.

The first cold forging device, second cold forging station forms the second end of the slug from the second end flat configuration having a first diameter to a second flat end having the second diameter with an adjacent second end radius. This reforms the second end of the slug to be identical with the first end of the slug. The second end radius runs from the second flat end to the first length circumference. The second end radius being the same as the first end radius. The slug has a first circumferential equator which is formed between the first end radius and the second end radius.

The next step provides the slug being removed from the first cold forging device and being placed in a second cold forging device. The second cold forging device has a hammer assembly and a die assembly.

The hammer assembly of the second cold forging device, like the first cold forging device hammer assembly, has a hammer case, a hammer insert, a hammer spacer, and a hammer pin. The second cold forging device hammer insert has a hole there through, through which the hammer pin passes. The second cold forging device hammer insert has a recess therein, with the recess having a third radius. The second cold forging device hammer pin has a flat end with a taper.

The second cold forging device die assembly, like the die assembly of the first cold forging device, has a die case, a die spacer, a die insert, and a die pin. The second cold forging device die insert has a hole there through, through which the die pin passes. The second cold forging device insert has a recess therein, with the recess having the third radius. The second cold forging device die pin has a flat end with a taper.

The second cold forging device compresses the slug and reforms both the first end of the slug and the second end of the slug, to obtain a slug having a second circumferential equator. Each end of the slug is reformed to have a third flat end diameter with the third end radius. Each end of the slug is formed to have a circumferential taper. Each end of the slug is formed to have an end recess with a recess taper. Each end of the second circumferential equator is greater than the first circumferential equator. The slug has a second over all length, with the second overall length being less than the first overall length.

The next step is providing a transfer of the slug from the second cold forging device to a hole punching device. The hole punching device has a first station, a second station, and a third station. The hole punching device first station has a die case, a die insert, a die spacer, and a hollow extrusion pin and an ejection pin.

Initially, the slug is located between the first station and the second station of the hole punching device. The second station has a hammer case, a hammer spacer, and a hammer insert. The die insert of the second station has a centrally located hole there through for passage of the hammer pin there through. The die insert of the second station has a hemispherically shaped recess, having a constant fourth radius.

The first and second stations work together. The hole punching device first station presses and advances the hollow tubular extrusion punch and the solid ejection punch through the slug, to form a partial aperture into the first end of the slug. The first end partial aperture of the slug has a tapered outer end. The first end partial aperture is pressed to about a mid length of the slug. The slug equator is reformed by displaced material during the partial hole pressing. The slug equator is formed into the constant third radius. The slug equator constant third radius is formed from about the mid length of the slug to the first end the slug. The hole punching device second station presses the hammer pin into the slug to form a partial aperture into the second end of the slug. The partial aperture of the second end of the slug has a tapered outer end. The second station of the hole punching device hammer insert has the fourth constant radius, and the second station forms the fourth curved radius on the slug. The fourth curved radius is formed on the second end of the slug, with the fourth curved radius being from about the mid length of the slug to the second end of the slug. The fourth curved radius is greater than the third curved radius.

The first station and second station are moved away from each other. During this process, the slug is held on the hollow tubular hole punch of the first station of the hole punching device, and the second station of the hole punching device then separates from the first station.

The third station of the hole punching device is then moved into position opposite of the first station of the hole punching device. The third station of the hole punching device has a hammer case, a central hammer pin, and a hammer insert. The hole punching device third station central pin is sized to be mated with and received by the partial aperture of the second end of the slug. The third station hammer insert has a hemispherically shaped recess having the constant third radius. The first station hollow tubular extrusion punch is then advanced through to the opposite end of the slug being the second end of the slug. This advancement presses the outer surface of the slug into the third constant radius, matching the radius of the first end of the slug and pressing the hole through the round slug. The pin of the hole punching device first station advances into the partial aperture of the second end completing the hole through the round slug. The ejection pin presses through the hollow tubular hole punch, clearing any material from the process, out of the hollow hole punch. The pin of the first station of the hole punching device is then withdrawn and the first and third stations are separated.

Whereby the devices form a near perfect ball bearing having a hole there through.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved process, or method, for manufacturing a near perfect round ball bearing with a hole there through, which has all of the advantages of the prior art methods to make ball bearings, and none of the disadvantages.

It is another object of the present invention to provide a new and improved process for manufacturing a near perfect round ball bearing with a hole there through which may be easily and efficiently manufactured and marketed.

It is further object of the present invention to provide a new and improved process for manufacturing a near perfect round ball bearing with a hole there through which is of durable and reliable construction.

An even further object of the present invention is to provide a new and improved process for manufacturing a near perfect round ball bearing with a hole there through which is susceptible of a low cost of manufacture with regard to both materials and labor, and which accordingly is then susceptible of low prices of sale to the consuming public, thereby making such process for manufacturing a near perfect round ball bearing with a hole economically available to the buying public.

Lastly, it is an object of the present invention to provide a new and improved process of compressing a slug to have tapered ends, then reforming the slug to change the configuration to a shorter length with a larger diameter across the center of the slug. The slug is then, again, reformed and a hole pressed there through, with the pressing of the partial hole reforming the configuration to have a near perfect radius with a hole through the slug, whereby a near prefect ball is made, and the ball has a hole there through.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is shown in FIG. 3B.

FIG. 7A is a side elevational cross section view of the third station of the hole punching device, showing the hammer pin extended. The resultant slug configuration is shown in FIG. 7A.

FIG. 7B is a side elevational cross section view of the third station of the hole punching device with the hammer pin withdrawn, which allows the ejector pin to push excess material into the hammer pin sheath, and then be withdrawn so that the excess material remaining from the final hole punching may then fall from the window in the sheath. The resultant slug configuration is shown in FIG. 7B.

FIG. 8A is a front elevational view of a transfer finger.

FIG. 8B is a side elevational view of a transfer finger.

FIG. 8C is a view along line 8C-8C of FIG. 8B, showing the end configuration of a transfer finger.

FIG. 10A is a side elevational view of the slug which is used at the beginning of the process.

FIG. 10B is a side elevational view of the slug configuration after the first end is formed, during the process.

FIG. 10C is a side elevational view of the slug configuration after the second end is formed, during the process.

FIG. 10D is a cross sectional view of the slug configuration after the slug is compressed, with recesses being made in both ends of the slug, during the process.

FIG. 10E is a cross sectional view of the slug configuration after the slug has the extrusion rod pushed partially through the slug, forming about half of the hole there through, during the process.

FIG. 10F is a cross sectional view of the slug configuration after the slug has the extrusion rod pushed through the entire slug, completing the formation of the hole there through, during the process.

The same reference numerals refer to the same parts throughout the various Figures.

DESCRIPTION OF THE PREFERRED EMBODIMENT

Figure 1:
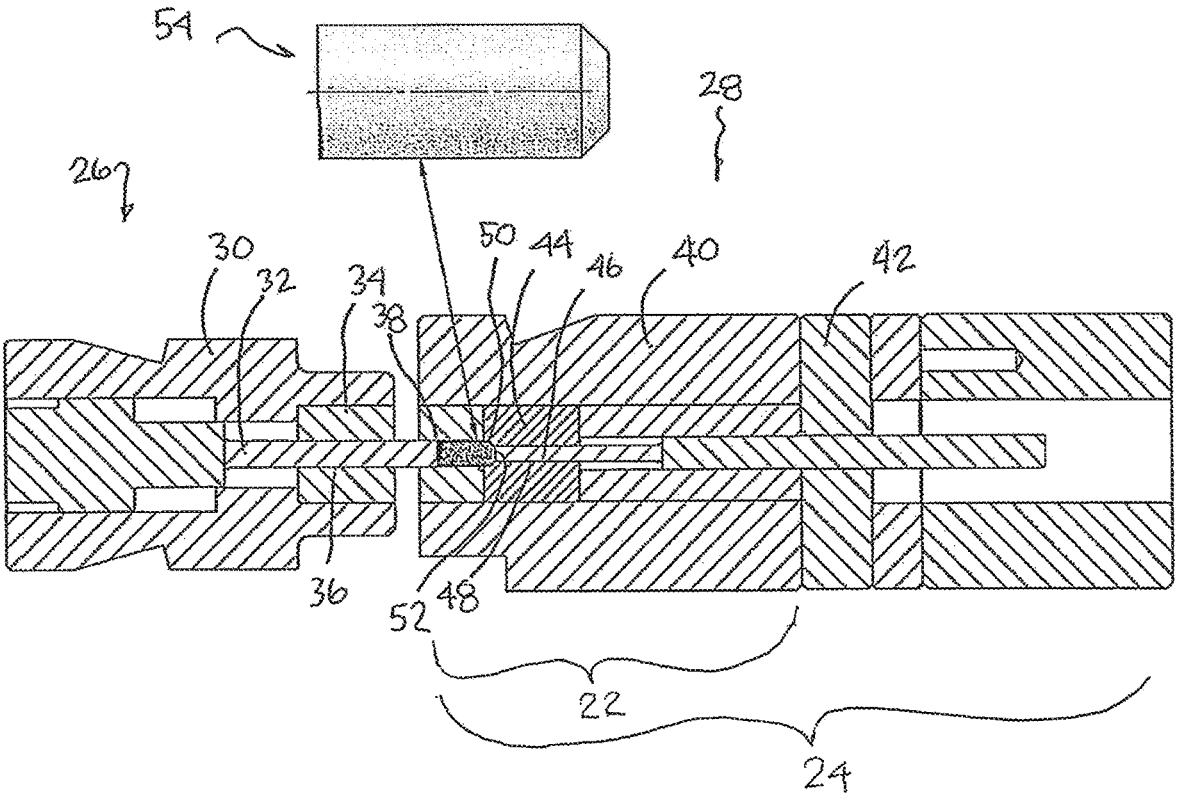
FIG. 1 is side elevational cross section of the first forging device first forging station, wherein the first end of the slug is reformed.
Figure 2:
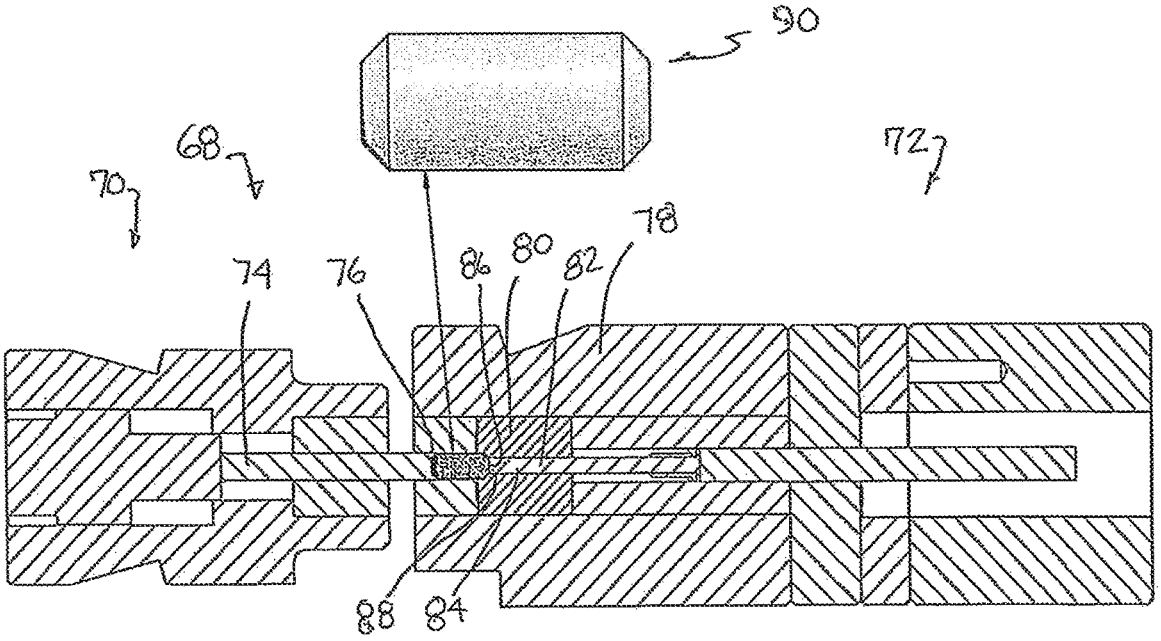
FIG. 2 is a side elevational cross section of the first cold forging device second forging station wherein the second end of the slug is reformed to be the same as the first end of the slug.
Figure 3A:
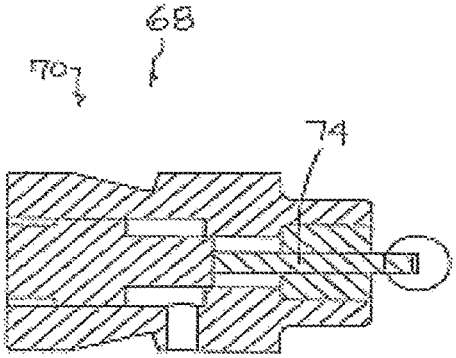
FIG. 3 A is a close up elevational cross section of the hammer device of FIG. 2, showing the hammer insert and hammer pin.
FIG. 3B is a close up elevational cross section of the hammer pin end, which is the circle of FIG. 3A. A drawing of the pin which results from the operation of the device is
Figure 3B:
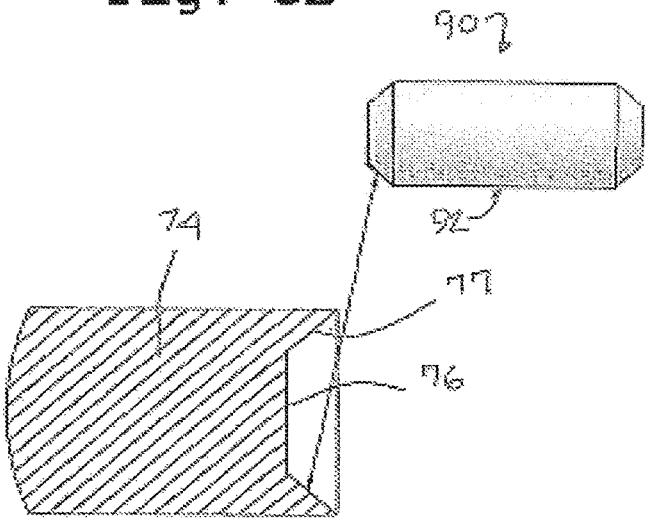
Figure 4A:
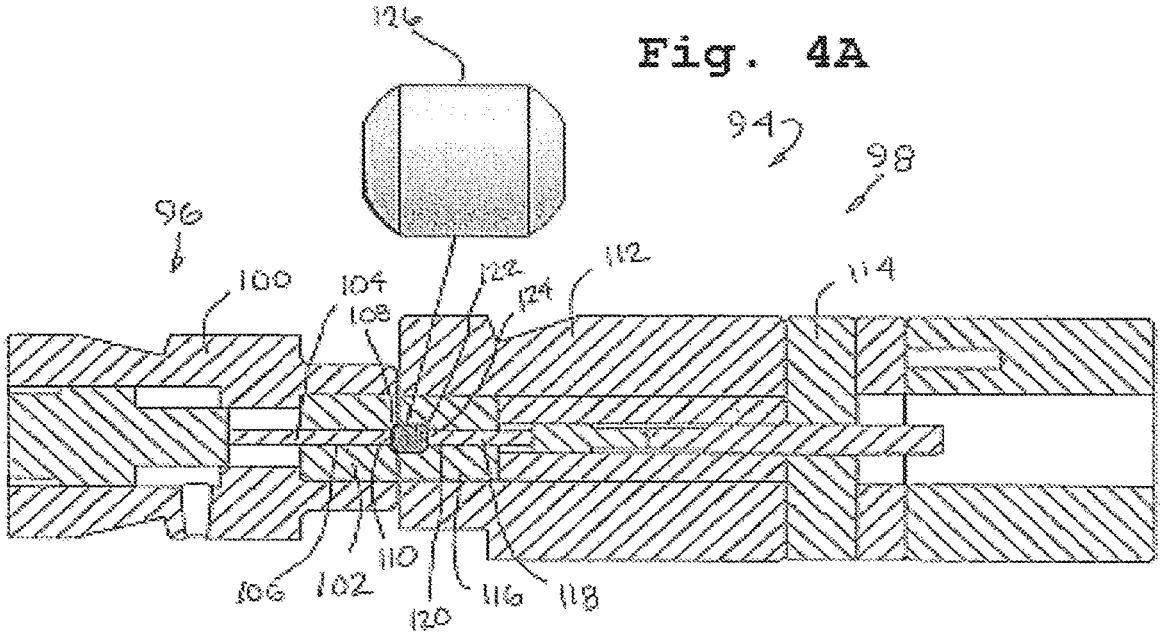
FIG. 4A is a elevational cross section view of the second cold forging device, showing the reforming of the slug to a lesser length and a greater equatorial diameter.
Figure 4B:
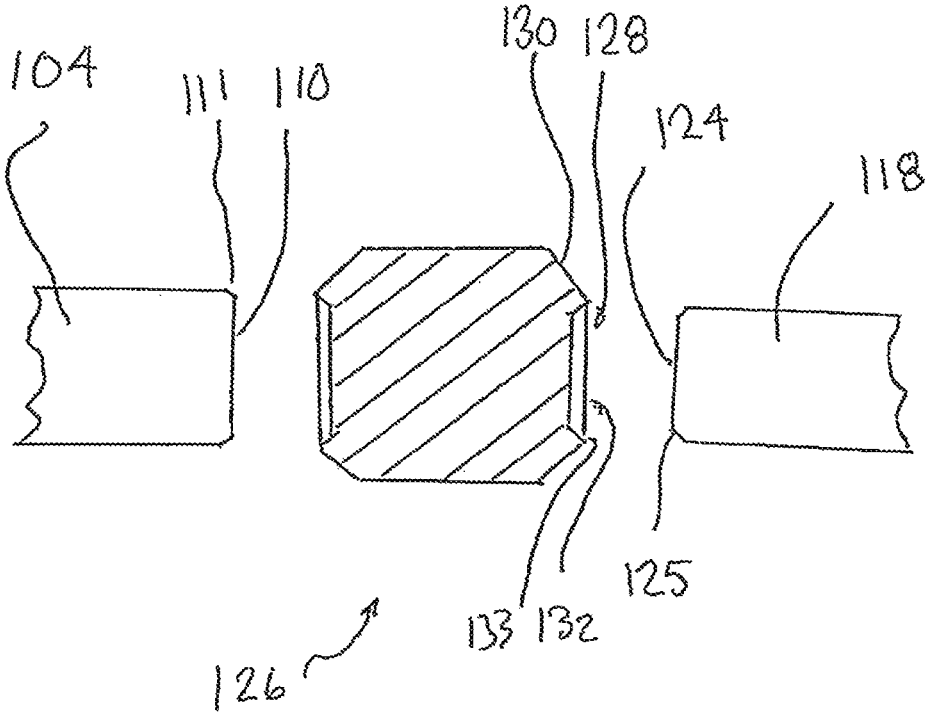
FIG. 4B is a side elevational view of the slug between the hammer pin and the die pin of FIG. 4A.
Figure 5A:
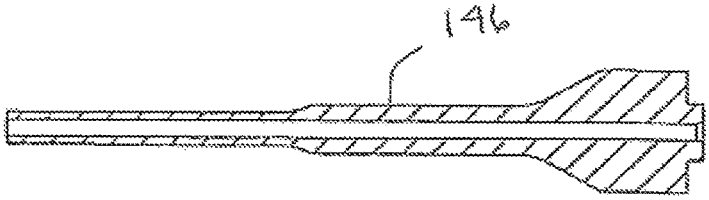
FIG. 5A is a cross sectional view of the hollow extrusion pin.
Figure 5B:
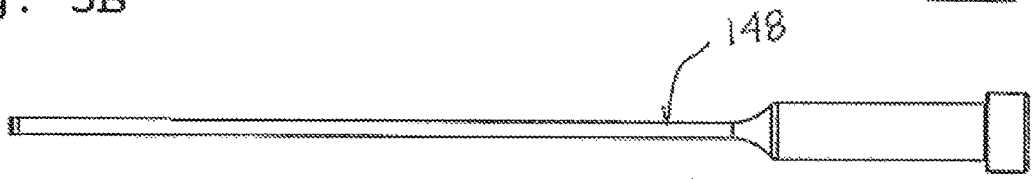
FIG. 5B is a side elevational view of the ejection pin.
Figure 5C:
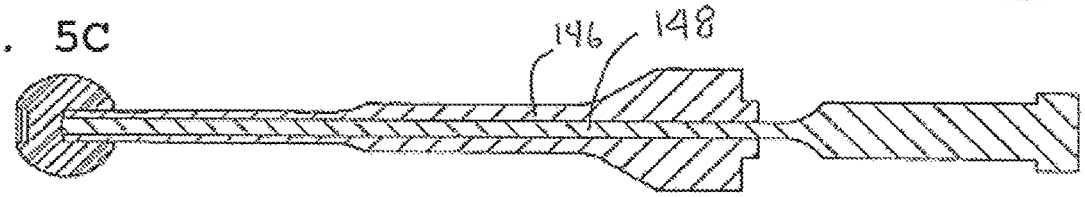
FIG. 5C is a cross sectional view of the hollow extrusion pin with the ejection pin running there through, with the formed slug being located on the end of the extrusion pin.
Figure 5D:
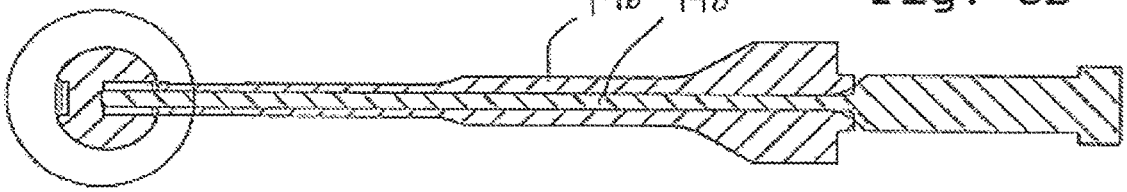
FIG. 5D is a cross sectional view of the hollow extrusion pin with the ejection pin being in the advanced location, pushing the ball off of the extrusion pin.
Figure 5E:
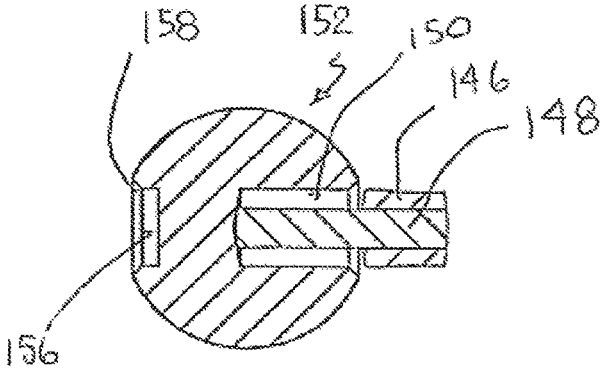
FIG. 5E is a view in the circled area of FIG. 5D, showing a close up view of the slug with the ejection pin being in the advanced location, pushing the ball off of the extrusion pin.
Figure 6:
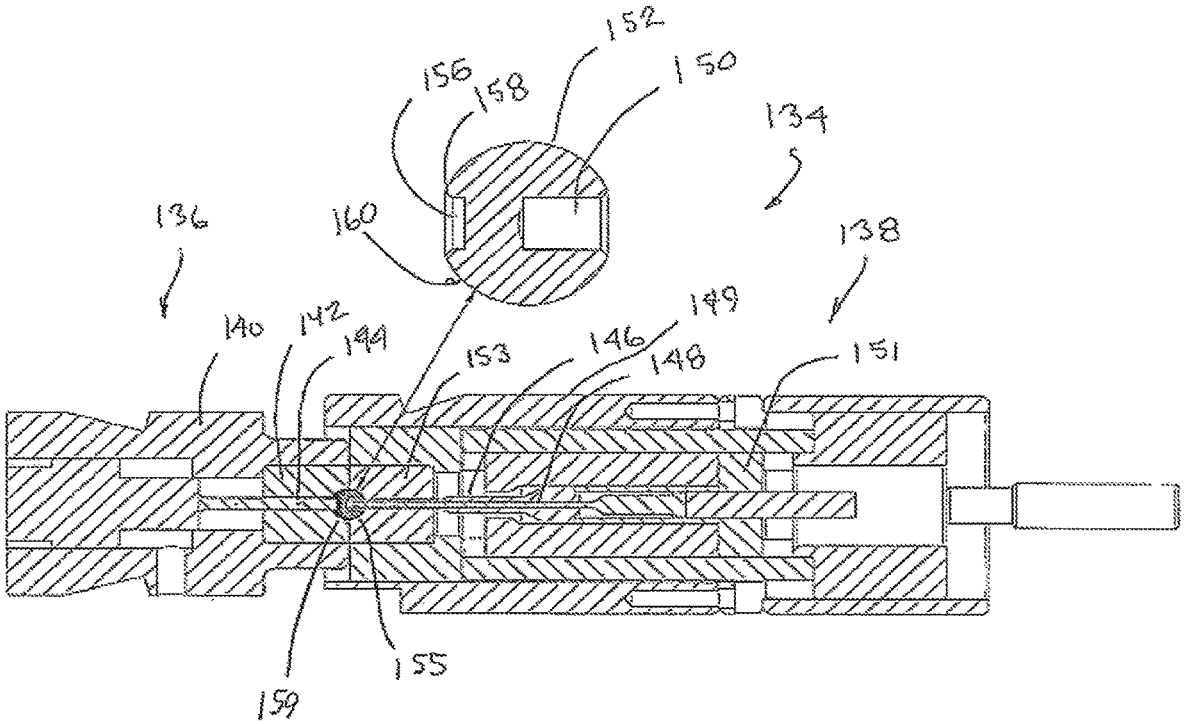
FIG. 6 is a side elevational cross section view of the first station and the second station of the hole punching device, showing the first station and the second station in operational alignment.
Figure 9:
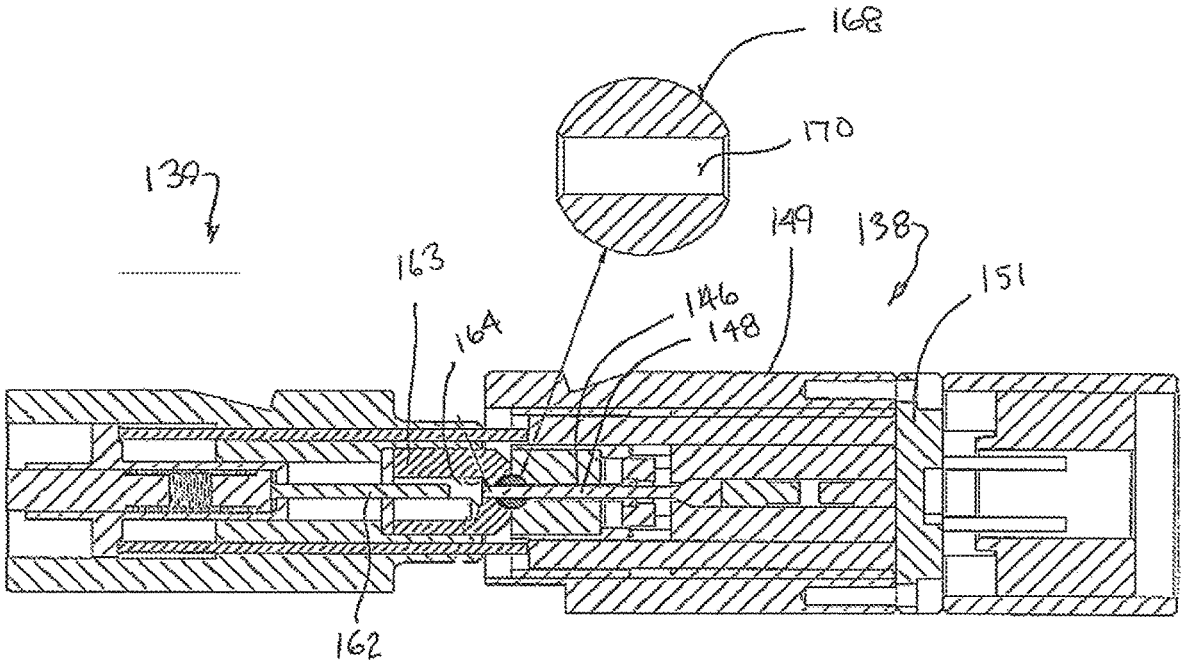
FIG. 9 is a side elevational cross section of the cooperation of the first station and the second station of the hole punching device. The resultant slug with the hole there through is shown above the device.

With reference now to the drawings, and in particular to FIG. 1 thereof, the preferred embodiment of the new and improved process for manufacturing a near perfect round ball bearing with a hole there through, embodying the principles and concepts of the present invention will be described.

The present invention, the process for manufacturing a near perfect round ball bearing with a hole there through is comprised of a plurality of steps. Such steps in their broadest context include a step for forming the first end of the slug, a step for forming the second end of the slug, a step for compressing the slug to a form approaching a near rounded configuration, and a step for pressing a hole through the slug, with the pressing expanding the slug to a predetermined die configuration, resulting in a near perfectly round ball bearing with a hole there through. Such steps are individually configured and correlated with respect to each other so as to attain the desired objective.

Herein described are the process steps for manufacturing a near perfect round ball bearing with a hole there through. The process, or method, comprises several steps, in combination.

The first step is providing a slug of a material 12. The slug has a round solid tubular configuration. The slug has a first end 14 and a second end 16, with a first overall length there between. The length of the slug has a centerline 18 which defines the central axis of the slug. The slug first length has a mid length 20 which locates the middle of the length of the slug, or the middle of the slug. The first length of the slug has a first length circumference and first length radius. The first end of the slug and the second end of the slug each have the first length radius.

The second step is providing placing the slug into a first cold forging device 22. The first cold forging device has a first cold forging station 24 and a second cold forging station. The first cold forging device has a hammer assembly 26 and a die assembly 28. The hammer assembly has a hammer assembly case 30, hammer pin 32, and a hammer insert 34. The hammer insert has a centrally located hole 36 there through, through which the hammer pin passes. The hammer pin has a flat end surface 38. The die assembly has a die case 40, a dies spacer 42, and a die insert 44 and a die pin 46. The die insert has a centrally located hole 48 there through, through which the die pin passes. The die insert has a centrally located recess 50 therein with the centrally located insert recess having a radial configuration, having a first end radius, around an insert die pin hole. The die pin of the first cold forging device, first cold forging station has a flat end 52 having a second diameter.

The first cold forging device first cold forging station die forms the slug into a second configuration 54 in which the first end of the slug to a configuration having a flat first end 56 having the second diameter with an adjacent first end radius 58. The first end radius runs from the first flat end to the first length circumference. The second end of the slug is contacted by the hammer pin of the hammer assembly, and is maintained in a flat, first diameter, configuration 60.

The next step is providing a turn around device using a transfer fingers 62. Each of the transfer fingers has a hollow tubular configuration 64 with a transfer hole 66 therein. The turn around device grips the slug and removes the slug from the first cold forging device first cold forging station and then turns the slug one hundred and eighty degrees and then the transfer fingers insert the slug into the first cold forging device second cold forging station.

The next step provides the first cold forging device second cold forging station 68 reforming the second end of the slug. The second cold forging station, like the first cold forging station, has a hammer assembly 70 and a die assembly 72. The first cold forging device second cold forging station hammer assembly has a hammer pin 74 with a configuration which mates with the slug first flat end 76, having the second diameter, and the adjacent first end radius 77. The die assembly has a die case 78 and a die insert 80 and a die pin 82. The die insert has a centrally located hole 84 there through, through which the die pin passes. The die pin of the first cold forging device second cold forging station has a flat end 86. The first cold forging device second cold forging station die insert has a centrally located recess 88 therein with the centrally located insert recess having a radial configuration, having the first end radius, around the insert hole.

The first cold forging device, second cold forging station forms the second end of the slug from the second end flat configuration having a first diameter to a second flat end having the second diameter with an adjacent first end radius 90. This reforms the second end of the slug to be identical with the first end of the slug. The second end first radius runs from the second flat end to the first length circumference. The second end radius being the same as the first end radius. The slug has a first circumferential equator 92 which is formed between the first end radius and the second end radius.

The next step provides the slug being removed from the first cold forging device and being placed in a second cold forging device 94. The second cold forging device has a hammer assembly 96 and a die assembly 98.

The hammer assembly of the second cold forging device, like the first cold forging device hammer assembly, has a hammer case 100, a hammer insert 102, and a hammer pin 104. The second cold forging device hammer insert has a centrally located hole 106 there through, through which the hammer pin passes. The second cold forging device hammer insert has a recess 108 therein, with the recess having a third radius. The second cold forging device hammer pin has a flat end 110 with a taper 111.

The second cold forging device die assembly, like the die assembly of the first cold forging device, has a die case 112, a die spacer 114, a die insert 116, and a die pin 118. The second cold forging device die insert has a centrally located hole 120 there through, through which the die pin passes. The second cold forging device insert has a recess 122 therein, with the recess having the third radius. The second cold forging device die pin has a flat end 124 with a taper 125.

The second cold forging device compresses the slug and reforms both the first end of the slug and the second end of the slug, to obtain a slug having a second circumferential equator 126. Each end of the slug is reformed to have a third flat end diameter 128 with the third end radius. Each end of the slug is formed to have a circumferential taper 130. Each end of the slug is formed to have an end recess 132 with a recess taper 133. The second circumferential equator is greater than the first circumferential equator. The slug has a second over all length, with the second overall length being less than the first overall length.

The next step is providing a transfer of the slug from the second cold forging device to a hole punching device 134. The hole punching device has a first station 136, a second station 138, and a third station 139.

The hole punching device first station has a die case 140, a die insert 142, a die spacer 144, and a hollow extrusion pin 146 and an ejection pin 148.

Initially, the slug is located between the first station and the second station of the hole punching device. The second station has a hammer case 149, a hammer pin 150, and a hammer insert 151. The hammer insert of the second station has a hemispherically shaped recess 152, having a constant fourth radius. The first and second stations work together. The hole punching device first station presses and advances the hollow tubular extrusion punch and the solid ejection punch through the slug, to form a partial aperture 153 into the first end of the slug. The first end partial aperture of the slug has a tapered outer end 154. The first end partial aperture is pressed to about a mid length of the slug. The slug equator is reformed by displaced material during the hole pressing. The slug equator is formed into the constant third radius 155. The slug equator constant third radius is formed from about the mid length of the slug to the first end the slug.

The hole punching device second station presses the pin 150 into the slug to form a partial aperture 156 into the second end of the slug. The partial aperture of the second end of the slug has a tapered outer end 158. The second station forms the fourth curved radius 160 on the slug. The fourth curved radius is formed on the second end of the slug, with the fourth curved radius being from about the mid length of the slug to the second end of the slug. The fourth curved radius is greater than the third curved radius.

The first station and second station are moved away from each other. During this process, the slug is held on the hollow tubular hole punch of the first station of the hole punching device, and the second station of the hole punching device then separates from the first station.

The third station of the hole punching device 139 is then moved into position opposite of the first station of the hole punching device. The third station of the hole punching device has a hammer case 161, a central reciprocating hammer pin 162, a hammer insert 163, a hollow pin sheath 164, and a hammer pin spring 166. The hammer pin spring of the third station of the hole punching device allows the hammer pin to be both advanced and retracted, that is, the hammer pin reciprocates. The hole punching device third station central pin is sized to be mated with and received by the partial aperture of the second end of the slug. The third station hammer insert has a hemispherically shaped recess 168 having the constant third radius. The hammer pin loads the slug into the first station die insert and indexes the slug in a predetermined position. Once the slug is loaded, the hammer spring compresses and withdraws the third station hammer pin.

Once the slug is seated within the first station die insert recess and the first station and third station are aligned and mated, the first station hollow tubular extrusion punch is then advanced through to the opposite end of the slug, being the second end of the slug. This advancement presses the outer surface of the slug into the third constant radius of the hammer insert, matching the radius of the first end of the slug and pressing the hole through the round slug. The pin of the hole punching device first station advances into the partial aperture of the second end completing the hole through the round slug. The ejection pin presses through the hollow tubular hole punch, clearing any material from the process, out of the hollow hole punch, into the hammer pin sheath. The excess material 167 falls through a window 169. Once the ejection pin clears the extrusion pin of any excess material, the ejection pin and extrusion pin of the first station are then both withdrawn and the first and third stations are separated.

Whereby the devices form a near perfect ball bearing 168 having a hole 170 there through.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A process for manufacturing a near perfect round ball bearing having a hole there through, comprising, in combination, the steps of:

providing a slug of a material having a round solid tubular configuration having a first end and a second end with a first length there between, the first length having a mid length, the slug having a first length circumference, the first end of the slug and the second end of the slug each having a central axis and a first diameter;

placing the slug into a first cold forging device;

wherein the first cold forging device having a first cold forging station and a second cold forging station, the first cold forging station forming the first end of the slug to a flat first end with an adjacent first end radius, the first end radius extending from the first flat end to the first length circumference;

wherein a turn around device removes the slug from the first cold forging station and then turns the slug one hundred and eighty degrees and then inserts the slug into the second cold forging station;

wherein the second cold forging station forms the second end of the slug to a flat second end with an adjacent second end radius, the second end radius extends from the second flat end to the first length circumference, the second end radius being the same length as the first end radius, the slug having a first circumferential equator which is formed between the first end radius and the second end radius;

wherein the slug is removed from the first cold forging device and is placed in a second cold forging device, with the second cold forging device compressing the slug to obtain a second length and a second diameter, the second cold forging device compressing the first end of the slug and the second end of the slug to reform the slug to have the first flat end with a second first end radius and the second flat end with a second flat end radius, a second circumferential equator is formed between the first end and the second end with the second circumferential equator being a greater length than the first circumferential equator;

wherein the slug is transferred from the second cold forging device to a hole punching device, the hole punching device having a first station, a second station and a third station, the first station having a die case, a die, a hollow tubular extrusion punch and a solid ejection punch, the slug being located between the first station and the second station of the hole punching device, the hole punching device first station presses and advances the hollow tubular extrusion punch and the solid ejection punch through the slug to form a partial aperture into the first end of the slug, the first end partial aperture of the slug having a tapered outer end, the first end partial aperture being pressed to a mid length of the slug, wherein the slug equator is reformed by displaced material during the hole pressing with the slug equator being formed into a constant third radius, and the constant third radius is formed from the mid length to the first end;

wherein the second station has a hammer case, a hammer insert and a hammer pin, the slug is seated in the second station while the hammer insert is pressing the hammer pin into the slug to form a partial aperture into the second end of the slug, the partial aperture has a tapered outer end, the second station of the hole punching device forming a fourth curved radius on the slug, the fourth curved radius being formed on the second end of the slug with the fourth curved radius extending from the mid length of the slug to the second end, the fourth curved radius is greater in length than the third curved radius, the slug is held on the hollow tubular hole punch of the first station, and the first station of the hole punching device and the second station of the hole punching device then separating from each other;

wherein the third station of the hole punching device is then moved into position opposite of the first station of the hole punching device;

wherein the third station has a hammer case, a hammer insert and a hammer pin, the hammer pin being sized to be mated with the partial aperture of the second end of the slug, the hammer insert having a recess having the third radius and a central hole there through, the extrusion pin of the first station of the hole punching device is then advanced through the slug and into the central hole of the third station hammer insert, thereby completing the hole through the slug from the first end of the slug to the second end of the slug, pressing a hole through to the second end of the slug thereby reforming the second end fourth radius into the third radius;

wherein the ejector pin is then advanced thereby pushing any material which has accumulated within the extrusion pin out of the extrusion pin and into the hammer insert of the third station of the hole punching device;

whereby the near perfect round ball bearing having the hole there through is formed.

2. A process for manufacturing a near perfect round ball bearing having a hole there through, comprising, in combination the steps of:

providing a slug of a material having a round solid tubular configuration;

providing a first cold forging device comprising a first cold forging station and a second cold forging station;

placing the slug into the first cold forging station and reforming the slug to have a first flat end with an adjacent first end radius and a second end;

wherein the second cold forging station reforms the second end of the slug to a flat second end with an adjacent second end radius, the second end radius being the same length as the first end radius, the slug having a first circumferential equator which is formed between the first end radius and the second end radius;

wherein a second cold forging device compresses the first end of the slug and the second end of the slug to reform the slug to have the first flat end with a second first end radius and the second flat end with a second flat end radius, a second circumferential equator being formed between the first end and the second end, the second circumferential equator being a greater length than the first circumferential equator;

providing a hole punching device, the hole punching device having a first station, a second station and a third station, the first station pressing and advancing a hollow tubular extrusion punch and a solid ejection punch through the slug to form a partial aperture into the first end of the slug to a mid length of the slug, the slug is seated in the second station while the hammer insert is pressing the hammer pin into the slug to form a partial aperture into the second end of the slug, wherein the slug is held on the hollow tubular extrusion punch of the first station and the first station of the hole punching device and the second station of the hole punching device then separating from each other, the third station of the hole punching device then being moved into a position opposite of the first station of the hole punching device;

wherein the third station having a reciprocating hammer pin which extends to seat the slug in the first station and then retracts allowing the extrusion pin to be advanced through the slug thereby completing the hole through the slug;

wherein the ejector pin being advanced is thereby pushing any material which has accumulated within the extrusion pin out of the extrusion pin and into the third station of the hole punching device;

whereby the devices form a near perfect round ball bearing having the hole there through is formed;

wherein the slug having a first end and a second end with a first length there between, the first length having the mid length, the slug having a first circumference, the first end the slug and the second end of the slug each having a central axis and a first diameter;

providing a turn around device, the turn around device removing the slug from the first cold forging station, then turning the slug one hundred and eighty degrees, and then inserting the slug into the second cold forging station; and wherein the first circumferential equator is formed between the first end radius and the second end radius.

* * * * *